US006386909B1

(12) United States Patent
Hsia et al.

(10) Patent No.: US 6,386,909 B1
(45) Date of Patent: May 14, 2002

(54) CARD CONNECTOR

(75) Inventors: Chih-Hui Hsia, Taipei; L. W. Lu, Tao-Yuan Hsien, both of (TW)

(73) Assignee: FCI Americas Technology, Inc., Reno, NV (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/013,495

(22) Filed: Jan. 26, 1998

Related U.S. Application Data

(63) Continuation of application No. 08/775,532, filed on Jan. 2, 1997, now Pat. No. 5,713,747, which is a continuation of application No. 08/369,614, filed on Jan. 6, 1995, now abandoned.

(51) Int. Cl.[7] ..... H01R 13/60
(52) U.S. Cl. ..... 439/541.5
(58) Field of Search ..... 439/59, 64, 74, 439/79, 80, 541.5

(56) References Cited

U.S. PATENT DOCUMENTS

| | | | | |
|---|---|---|---|---|
| 3,478,251 A | | 11/1969 | Perotto et al. | 317/101 |
| 3,566,190 A | * | 2/1971 | Huebner et al. | 439/357 |
| 3,653,006 A | | 3/1972 | Kohler et al. | 340/173 SP |
| 3,676,746 A | | 7/1972 | Kassabgi et al. | 317/101 CC |
| 3,736,471 A | | 5/1973 | Donze et al. | 361/684 |
| 3,871,728 A | | 3/1975 | Goodman | |
| 4,380,360 A | * | 4/1983 | Parmer et al. | 439/76.1 |
| 4,498,717 A | * | 2/1985 | Reimer | |
| 4,600,256 A | | 7/1986 | Antilla | 339/17 M |
| 4,630,874 A | * | 12/1986 | Renn et al. | 439/495 |
| 4,755,911 A | | 7/1988 | Suzuki | 361/414 |
| 4,858,070 A | | 8/1989 | Buron et al. | 361/384 |
| 4,964,806 A | | 10/1990 | Sakamoto et al. | 439/79 |
| 4,997,377 A | | 3/1991 | Goto et al. | 439/68 |
| 5,038,308 A | | 8/1991 | Le et al. | 361/685 |
| 5,085,590 A | | 2/1992 | Galloway | 439/95 |
| 5,113,317 A | | 5/1992 | Howe | 361/413 |
| 5,151,033 A | | 9/1992 | Kawai et al. | 439/95 |
| 5,161,999 A | | 11/1992 | Broschard et al. | 439/567 |
| 5,194,010 A | | 3/1993 | Dambach et al. | 439/79 |
| 5,201,662 A | | 4/1993 | Roche | 439/79 |
| 5,224,019 A | | 6/1993 | Wong et al. | 361/393 |
| 5,224,865 A | | 7/1993 | Woith | 439/67 |
| 5,225,968 A | | 7/1993 | Ma | 361/413 |

(List continued on next page.)

FOREIGN PATENT DOCUMENTS

TW 238008 1/1982

OTHER PUBLICATIONS

IBM Technical Disclosure Bulletin, vol. 33 No. 8, Jan. 1991.

*Primary Examiner*—Neil Abrams
(74) *Attorney, Agent, or Firm*—Woodcock Washburn LLP

(57) ABSTRACT

A memory card connector which comprises a header and a carrier connected to the header, wherein the header is provided with a plurality of pins extended in both inward and outward directions. The inward pins are used for inserting a memory card to be received in the carrier. A vertical circuit board is electrically and securely connected to the outward pins of the header. The lower end of the vertical circuit board is detachably inserted into a female connector securely mounted to the surface of a mainboard for electrical connection. The height of the circuit board can be set according to the requirement of a specific application of the memory card connector so that the space between the memory card connector and the mainboard can be properly utilized.

8 Claims, 3 Drawing Sheets

U.S. PATENT DOCUMENTS

| | | | | |
|---|---|---|---|---|
| 5,259,783 | A | | 11/1993 | Hileman et al. ..... 439/372 |
| 5,260,854 | A | | 11/1993 | Hileman et al. ..... 361/736 |
| 5,267,876 | A | | 12/1993 | Rupert et al. ..... 439/540 |
| 5,268,820 | A | | 12/1993 | Tseng et al. ..... 361/785 |
| 5,277,615 | A | | 1/1994 | Hastings et al. ..... 439/377 |
| 5,286,207 | A | | 2/1994 | McHugh ..... 439/64 |
| 5,290,174 | A | | 3/1994 | Woratyla et al. ..... 439/59 |
| 5,297,966 | A | | 3/1994 | Brennian et al. ..... 439/64 |
| 5,299,089 | A | | 3/1994 | Lwee ..... 361/684 |
| 5,305,182 | A | | 4/1994 | Chen et al. ..... 439/65 |
| 5,308,251 | A | | 5/1994 | Kaufman et al. ..... 439/64 |
| 5,316,488 | A | | 5/1994 | Gardner et al. ..... 439/79 |
| 5,318,452 | A | | 6/1994 | Brennian et al. ..... 439/79 |
| 5,324,204 | A | | 6/1994 | Lwee ..... 439/64 |
| 5,334,046 | A | | 8/1994 | Brouillette et al. ..... 439/540 |
| 5,384,435 | A | * | 1/1995 | Fuerst ..... 439/77 |
| 5,399,105 | A | | 3/1995 | Kaufman et al. ..... 439/609 |
| 5,401,176 | A | | 3/1995 | Lwee ..... 439/64 |
| 5,408,386 | A | | 4/1995 | Ringer et al. ..... 361/785 |
| 5,415,569 | A | | 5/1995 | Colleran et al. ..... 439/620 |
| 5,490,791 | A | | 2/1996 | Yamada et al. ..... 439/159 |
| 5,709,568 | A | * | 1/1998 | Pan et al. ..... 439/541.5 |

* cited by examiner

CARD CONNECTOR

CROSS-REFERENCE TO RELATED APPLICATIONS

This application is a continuation of patent application Ser. No. 08/775,532, filed on Jan. 2, 1997 and issued as U.S. Pat. No. 5,713,747 on Feb. 3, 1998, which is a continuation of patent application Ser. No. 08/369,614, filed on Jan. 6, 1995, now abandoned.

BACKGROUND OF THE INVENTION

1. Field of the Invention

This invention relates to a connector, and more particularly, to a memory card connector for use in notebook computers, PC printers and palmtop computers which can expand the space under the connector for installing electronic components and can be maintained easily.

2. Brief Description of the Prior Developments

Rapid progress in various personal computer technologies and improvements in shrinking-size components may make notebook computers the most popular computers in the computer market in the future. For note book computers (or PC printers, palmtop computers) equipped with PCMCIA (Personal Computer Memory Card International Association) slots, memory card connectors are used for connecting PCMCIA cards loaded in the slots to the mainboard of the notebook. A conventional memory card connector is usually installed on a mainboard by using SMT (Surface Mounting Technology) which solders the pins of the connector directly to the surface of the mainboard. Such rigid connection usually causes serious maintenance problems if the connector is to be replaced later on. Besides, the bottom of the conventional memory card connector is directly placed on the surface of the mainboard. The occupied area under the connector can not be used for other purposes such as installing electronic components. Such waste in mainboard space is usually not tolerable in notebook computers which have very restrictive mainboard space.

SUMMARY OF THE INVENTION

The memory card connector of the present invention may be detachably mounted on a mainboard. The memory card connector comprises a header and a carrier connected to the header, wherein the header is provided with a plurality of pins extended in both inward and outward directions, and a vertical circuit board is electrically and securely connected to the outward pins of the header. The lower end of the circuit board is detachably inserted into a female connector of the mainboard.

In the memory card connector of the present invention the height of the circuit board of the connector can also be set according to the requirement of a specific application of the connector so that the space (stand-off) between the connector and the mainboard can be properly utilized.

Additionally, two memory card connectors which may be stacked together, such that the outward pins of the upper connector are longer than the outward pins of the lower connector and the two vertical circuit boards respectively connected to the upper and lower connectors are detachably and vertically connected to two corresponding female connectors of the mainboard separately.

BRIEF DESCRIPTION OF THE DRAWINGS

The memory card connector of the present invention will be more fully understood and appreciated by reference to the written specification in conjunction with the accompanying drawings in which.

DETAILED DESCRIPTION OF THE PREFERRED EMBODIMENTS

Figure 1:
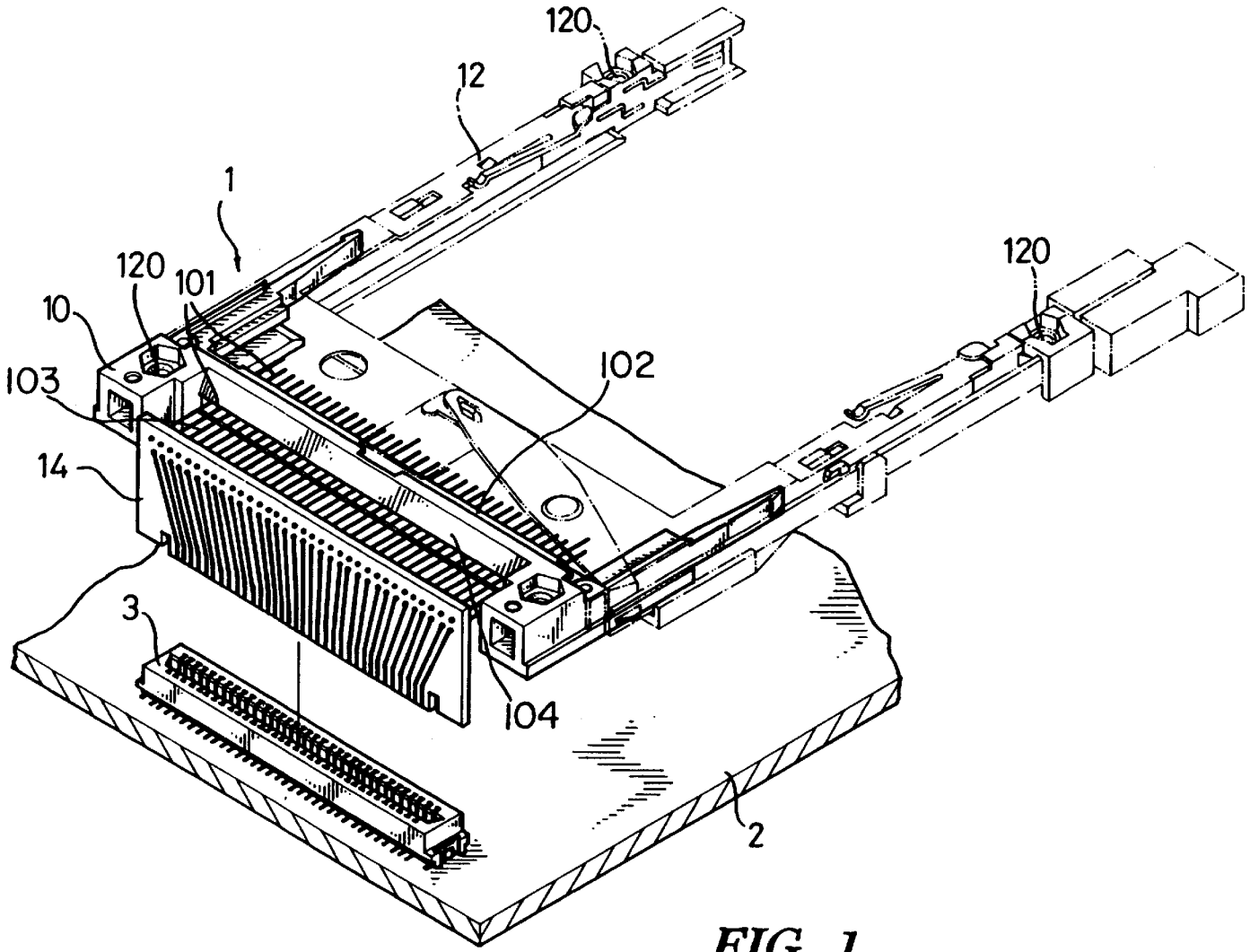
FIG. 1 is an exploded view of a memory card connector and its associated mainboard according to the present invention.

Referring now to FIG. 1, a memory card connector 1 according to the present invention comprises a header 10 and a carrier 12 connected to the header 10. The connection between the header 10 and the carrier 12 can be fixed or separated in the known manner, which is not the characteristic feature of the invention and is omitted in the description hereinafter. The header 10 is provided with a plurality of pins 101 extended in both inward and outward directions. The inward pins 101 extending from the inward edge 102 of the header are used for inserting a memory card (not shown) to be received in the carrier 12. A vertical circuit board 14 is electrically and securely connected to the outward pins 103 extending from the outward edge 104 of the header 10. A female connector 3 is securely mounted to the surface of a mainboard 2 for mounting the memory card connector 1. The lower end of the vertical circuit board 14 is detachably inserted into the female connector 3 to effect electrical connection.

Figure 2:
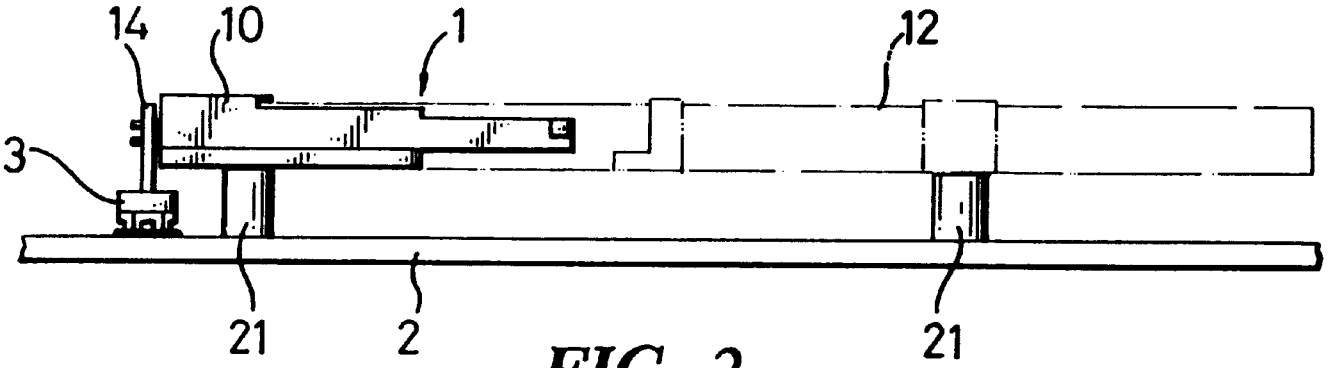
FIG. 2 is a side elevational view illustrating a memory card connector installed on a mainboard according to the present invention.

With reference to FIG. 2, in installing the connector 1 to the mainboard 2, the lower end of the circuit board 14 is directly plugged to the female connector 3 and the bottom of connector 1 is horizontally supported by four studs 21 provided on the mainboard 2. The connector 1 can be fastened to the studs 21 by using screws (not shown) respectively received in the four studs 21 passing through four screw mounting holes 120 of connector 1. The height of the circuit board 14 is set according to the requirement of a specific application of the memory card connector so that the space between the memory card connector 1 and the mainboard 2 can be properly utilized.

Figure 3:
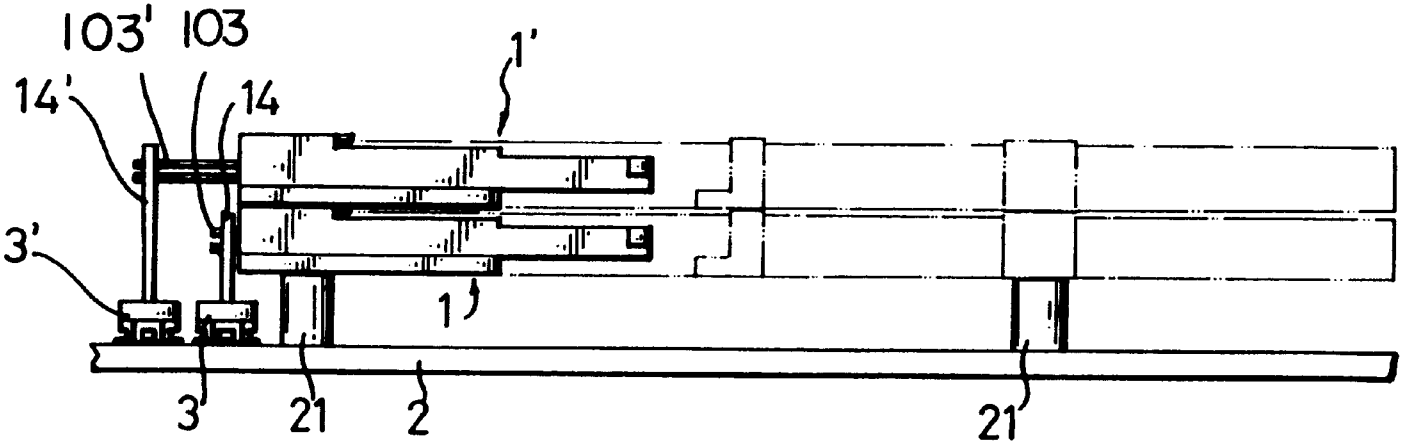
FIG. 3 is a side elevational view illustrating two memory card connectors stacked together and installed on a mainboard according to the present invention.

In FIG. 3, two memory card connectors 1 and 1' are stacked together and installed on the mainboard 2. The outward pins 103' of the upper connector 1' are longer than the outward pins 103 of the lower connector 1. Circuit board 14' in the upper connector 1' is larger to fit the real height as required. Two vertical circuit boards 14' and 14 respectively connected to the upper and lower connectors 1' and 1 are detachably and vertically connected to two corresponding female connectors 3' and 3 of the mainboard 2 separately.

Figure 4:
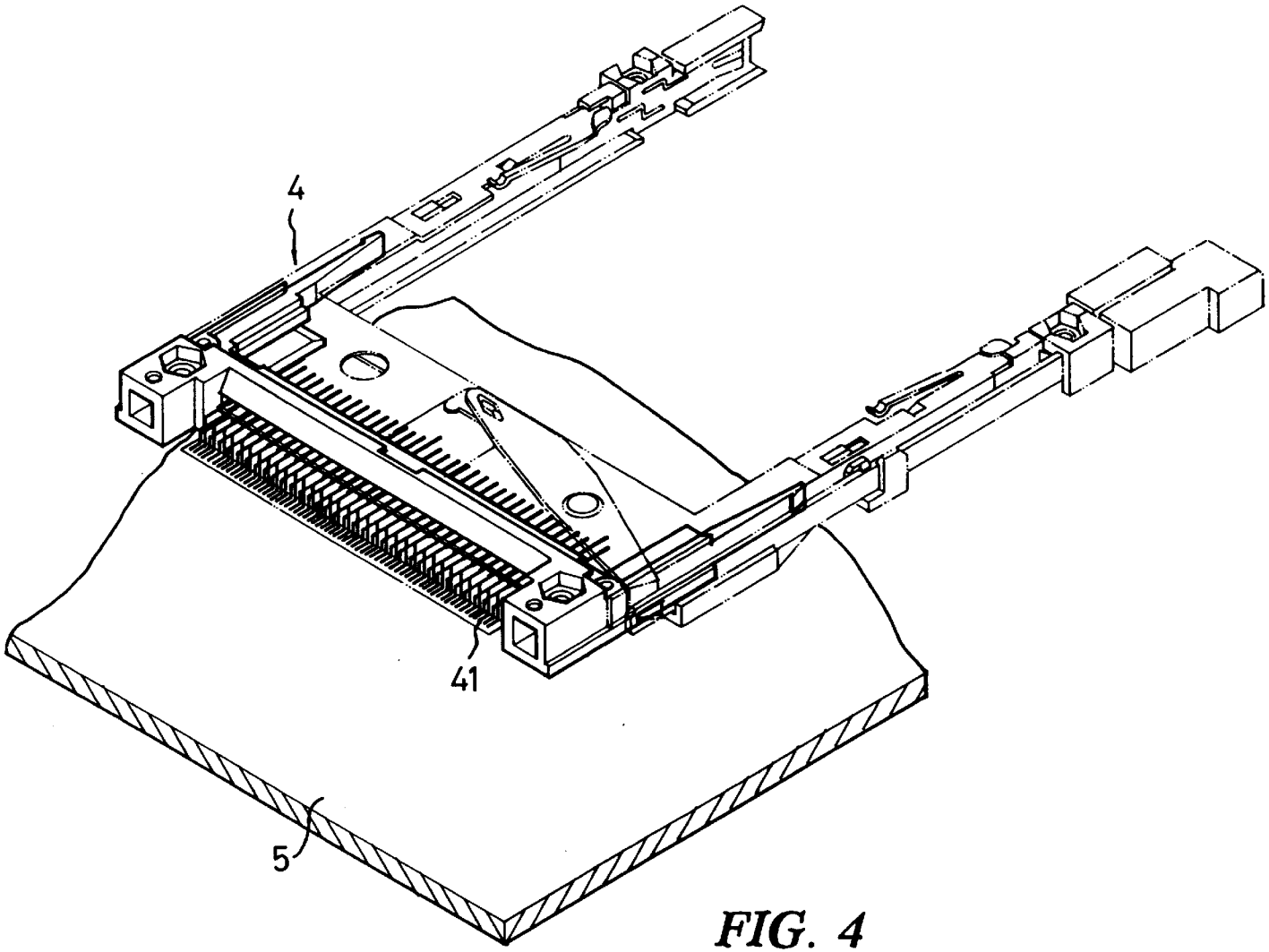
FIG. 4 (PRIOR ART)
FIG. 4 is a perspective view illustrating a conventional memory connector installed on a mainboard.

In FIG. 4, a conventional memory connector 4 installed on a mainboard 5 is illustrated. The connector 4 comprises a plurality of bending pins 41 which are directly soldered to the mainboard 5 by using SMT. As compared with the connector 1 in accordance with the present invention, it is difficult to replace the known installed connector 4 because it is securely fixed on the mainboard 5 which will cause a serious problem in maintenance. Furthermore, there is no space available under connector 4 for use such as installing electronic components.

It will be appreciated that a memory card connector has been described which provides an efficient and economical means for providing space for electronic components.

It will also be appreciated that a method for advantageously connecting a memory card connector to a main circuit board has been provided in which the outwardly extending pins are connected to a vertical circuit board and that vertical circuit board is connected to the main circuit board.

While the structure and features of the present invention have become more apparent from the above detailed description and illustration, it is to be understood that the embodiment has been described only by way of illustrating the preferred operation of the present invention without limiting the scope of the present invention. Therefore, it is intended that any modifications and changes that can be made to the embodiment without departing from the spirit of the present invention are within the scope as set forth in the appended claims.

What is claimed is:

1. A card connector for connecting cards to a main circuit board, comprising:

(a) a header for a first card having a plurality of pins;

(b) a circuit board having upper and lower ends and positioned generally transverse to the main circuit board and connected to the pins in said header for said first card;

(c) a connector mounted on the main circuit board wherein the lower end of the circuit board is detachably engaged with said connector;

(d) a header for a second card positioned in spaced parallel relation to said first header and having a plurality of pins; and (e) a second circuit board for connecting said header for said second card connector to said main circuit board.

2. The card connector of claim 1 wherein the circuit board for the first card and the circuit board for the second card each have heights and the height of the circuit board for the second card is greater than the height of the circuit board for the first card.

3. The card connector of claim 2 wherein the pins of the header for the second card and the pins of the header for the first card each extend outwardly from respective headers, the lengths of said outwardly extending pins of the header for the second card are greater than the lengths of the outwardly extending pins of the header for said first card.

4. The card connector of claim 1 further comprising a guide.

5. The card connector of claim 4, further comprising a second guide.

6. The card connector of claim 1 wherein the connector is a female connector.

7. A connector system for connecting PC cards to a main circuit board, comprising:

a pair of stacked PC card connectors mounted to the main circuit board, each having a header with a plurality of terminals;

at least one circuit board engaging said plurality of terminals of said pair of PC card connectors and arranged generally transverse to said main circuit board; and a card edge connector secured to said main circuit board and adapted to receive said at least one circuit board.

8. The connector system as recited in claim 7, wherein said PC card connectors are stacked against each other.

* * * * *